US005471967A

United States Patent [19]

Matsuzaki et al.

[11] Patent Number: 5,471,967

[45] Date of Patent: Dec. 5, 1995

[54] DISC DISCHARGING TOY

[75] Inventors: Tatsuya Matsuzaki; Hisashi Ishida, both of Tokyo, Japan

[73] Assignee: Toybox Corporation, Tokyo, Japan

[21] Appl. No.: 342,022

[22] Filed: Nov. 16, 1994

[30] Foreign Application Priority Data

Mar. 18, 1994 [JP] Japan ..... 6-003770 U

[51] Int. Cl.[6] ..... F41B 4/00

[52] U.S. Cl. ..... 124/6; 124/47; 124/51.1; 124/78; 124/82

[58] Field of Search ..... 124/4, 6, 32, 42, 124/43, 46, 47, 51.1, 78, 82, 16

[56] References Cited

U.S. PATENT DOCUMENTS

| | | | |
|---|---|---|---|
| 2,171,623 | 9/1939 | Connell | 124/6 X |
| 3,191,588 | 6/1965 | Thew | 124/42 X |
| 3,304,928 | 2/1967 | Darrell | 124/6 X |
| 3,548,801 | 12/1970 | Lohr et al. . | |
| 3,717,136 | 2/1973 | Gay et al. | 124/47 X |
| 4,463,745 | 8/1984 | Acker | 124/6 |
| 4,672,942 | 6/1987 | Steward | 124/78 X |
| 4,747,390 | 5/1988 | Storm | 124/6 |
| 4,910,646 | 3/1990 | Kim | 362/112 |
| 5,050,575 | 9/1991 | Killion | 124/8 |
| 5,281,182 | 1/1994 | Yoneda et al. | 446/289 |
| 5,396,876 | 3/1995 | Liscio et al. | 124/6 |

FOREIGN PATENT DOCUMENTS

| | | | |
|---|---|---|---|
| 1221593 | 5/1987 | Canada | 124/78 |

*Primary Examiner*—John A. Ricci
*Attorney, Agent, or Firm*—Morgan & Finnegan

[57] ABSTRACT

A disc discharging toy for discharging discs is provided which comprises a plurality of resilient discs, a magazine for holding the discs in a stacked position, a forcibly feeding device for forcibly feeding the discs so held in the supply portion piece by piece toward a discharging position, and a discharging device for discharging the disc so fed. The discharging device includes two rollers and a motor for rotating at least one of the two rollers in a direction in which the disc is discharged.

18 Claims, 6 Drawing Sheets

DISC DISCHARGING TOY

FIELD OF THE INVENTION

The present invention relates generally to toys and amusement devices, and, more specifically, to a toy for discharging discs.

A known disc discharging toy of this type is illustrated in FIG. 6, wherein a disc discharging toy 1 is configured such that it has the general appearance of a pistol. A disc 3 is loaded thereunto from the front with one hand, while the other hand holds a grip 2. A muzzle is directed to a direction in which the disc is to be discharged, and then a trigger 4 is pulled for discharging the disc 3.

In this type of disc discharging toy 1, as shown in FIG. 7, a pair of resilient arms 6, 6 are provided in a barrel portion 5 of the toy 1. The disc 3 is designed to be fitted from the front in between the pair of resilient arms 6, 6 in such a manner as to expand them.

When fully fitted in place, the disc 3 is adapted to be engaged and held in place by the resilient arms 6, 6, as seen in FIG. 8. At this moment, a pressing member 4a integrally formed on the trigger 4 is pressed by the disc 3. This causes the trigger 4 to rotate (in the clockwise direction of FIG. 7) about a shaft 4*b* so as to move away from the grip 2.

To discharge the disc 3, the trigger 4 is pulled or pressed to impart counter-clockwise rotation about the shaft 4*b*. This causes the pressing member 4*a* to press the disc 3 forward. Then, the pair of resilient arms 6, 6, which are engaging the disc 3, are gradually opened. When substantially a half of the disc 3 is forced out of the leading end of the pair of resilient arms 6, 6 (as shown in broken lines in FIG. 8), then the pair of resilient arms 6, 6 try to close, and the disc 3 is then discharged by the restoring force of the arms.

The disc discharging toy of the type shown in FIGS. 6–8 has several drawbacks. Namely, with the disc discharging toy 1 mentioned above, only one disc 3 can be loaded therein. Thus, a loading operation is required every time a disc 3 is to be discharged, and this is time consuming. In addition, since the toy is such that the disc 3 is discharged by means of the pair of resilient arms 6, 6, the spring force of the pair of resilient arms 6, 6 must be of a certain strength, while the disc 3 should be formed of a hard material such as plastics. However, in loading, in order to force a hard disc 3 in between a pair of resilient arms 6, 6 having a strong spring force, a substantially strong force is required. Thus, children, particularly infants, find the loading operation very difficult.

SUMMARY OF THE INVENTION

An object of the present invention is to provide a disc discharging toy in which a disc can easily be loaded.

This and other objects are met by providing a disc discharging toy for discharging discs which includes a plurality of resilient discs, a supply portion for holding a plurality of such discs that are layered over each other, a forcibly feeding device for forcibly feeding the discs held in the supply portion piece by piece to a discharging position, and a discharging device for discharging the discs that are forcibly fed by means of the forcibly feeding device, wherein the discharging device includes at least two rollers than can hold the disc, and a motor for rotating at least one of the two rollers in a direction in which the discs are discharged.

Preferably, the discs have a toroidal shape, and the toy is configured into the shape of a pistol, and the forcibly feeding device is configured so as to include a trigger and a forcibly feeding member adapted to interlock with the trigger to forcibly feed the disc to the discharging position.

In accordance with the above, the discs held layered in the supply portion are forcibly fed to the discharging position piece by piece by means of the forcibly feeding device, and the discs so fed are discharged by virtue of the rotation of the roller that is rotated in a direction in which the discs are discharged. Thus, since the supply portion can hold a plurality of discs in a state in which they are layered over each other, it is not required to load a disc every time it is discharged, thereby making it possible to discharge discs continuously. In addition, since the loading of discs can be completed only by putting them into the supply portion, it is possible that even infants can easily perform the disc loading operation.

DETAILED DESCRIPTION OF THE PREFERRED EMBODIMENT

Figure 1:
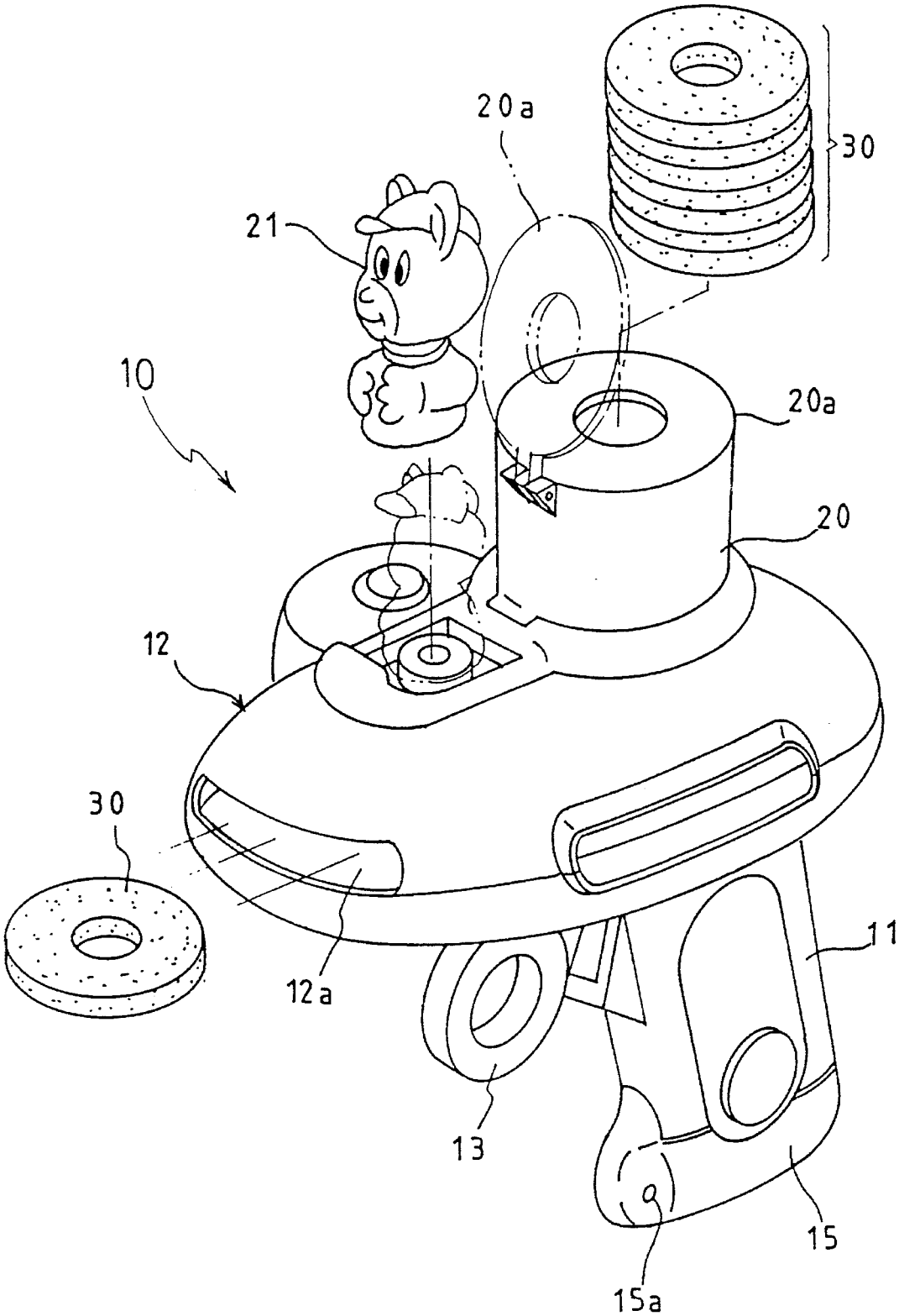
FIG. 1 is a front perspective view of a Preferred embodiment of the present invention.

Referring to FIG. 1, a disc discharging toy 10 is configured, as a whole, into a shape resembling a pistol. In particular, the disc discharging toy 10 includes a grip 11, a barrel portion 12, and a trigger 13 provided in the vicinity of the grip 11. In addition, a supply portion or magazine 20 is provided in such a manner as to be upstanding from a rear portion of the upper surface of the barrel portion 12. A figurine 21, such as a bear, is affixed to the barrel portion in front of the magazine 20.

The magazine 20 has a pivotally connected lid 20*a*. When pivoted to an open position (as shown in broken lines in FIG. 1), a plurality of discs 30 can be loaded into the magazine 20*a*. The discs 30 are made of a resilient material and have a hole in the middle, thus imparting a substantially toroidal shape. A typical number of discs to be loaded into the magazine would be about eight.

Figure 2:
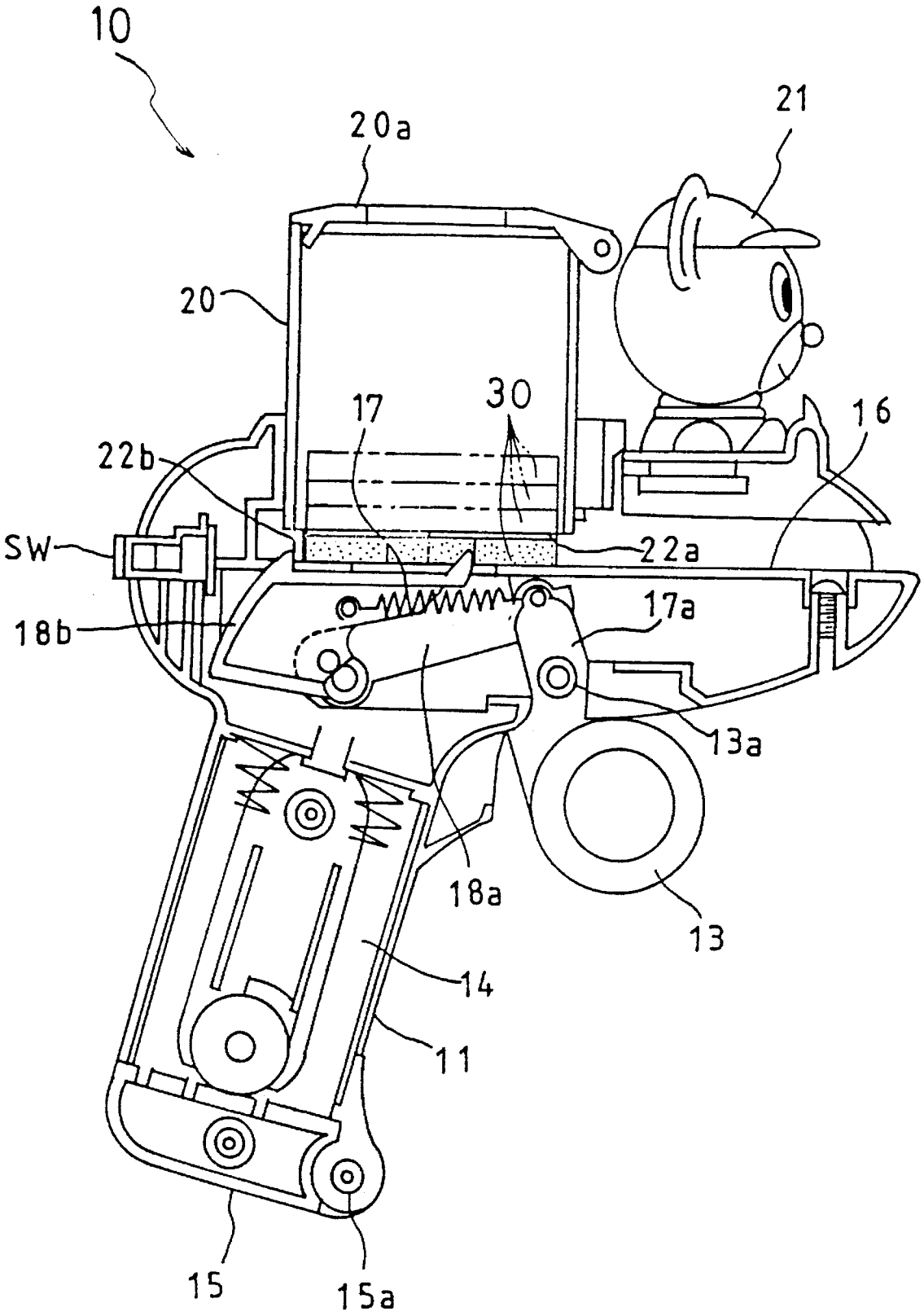
FIG. 2 is a side elevational view of the embodiment of FIG. 1, with portions removed to illustrate the interior.
Figure 3:
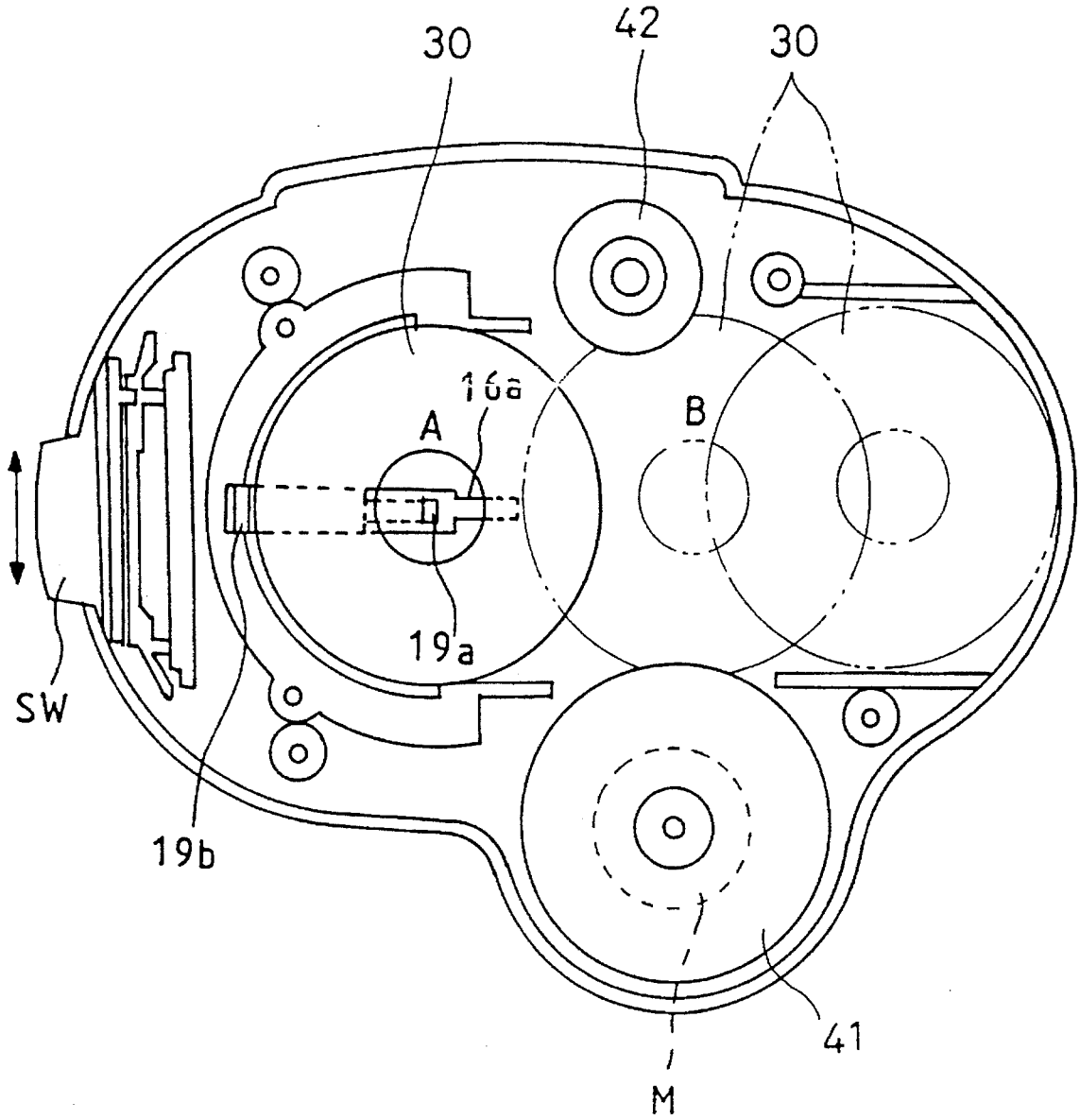
FIG. 3 is a top view of the embodiment of FIG. 1, with portions removed to illustrate the interior.

When a power switch SW, shown in FIGS. 2 and 3, and provided rearwardly of the barrel portion 12, is turned on and the trigger 13 is pressed, the discs 30 are discharged from a bore 12*a*.

As shown in FIG. 2, a battery compartment 14 is provided in the grip 11. In addition, provided at the bottom of the grip 11 is a lid 15 which can be opened and/or closed by pivoting about a shaft 15*a*, as shown in FIGS. 1 and 2. The lid 15 is opened when a battery or batteries (not shown) are loaded in or unloaded from the battery compartment 14.

As shown in FIG. 2, the barrel portion 12 is divided into two compartments, upper and lower, by a partition plate 16. A motor M, shown in FIG. 3, is mounted in the lower compartment, as well as a proximal portion of the trigger 13. The trigger 13 is rotatable about a shaft 13*a*, and is biased in a direction in which it is separated from the grip 11 by means of a spring 17 placed between the trigger and a fixed portion inside the barrel portion 12.

Figure 4:
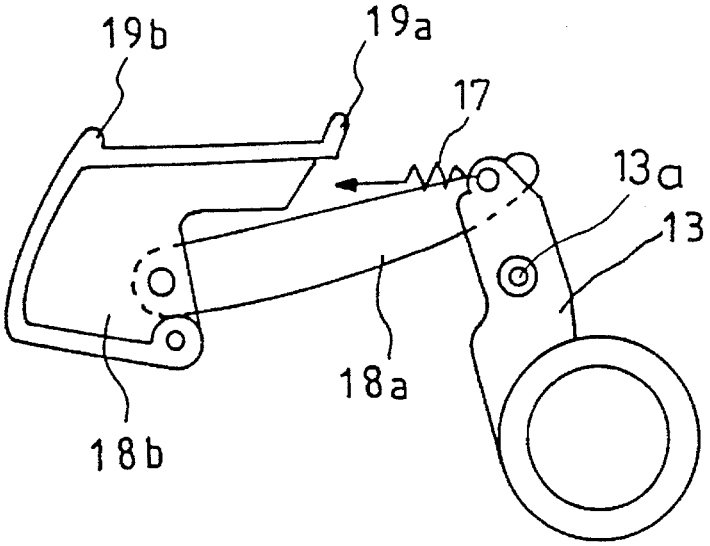
FIG. 4 is a side elevational view of the trigger mechanism used in the embodiment of FIG. 1.
Figure 5:
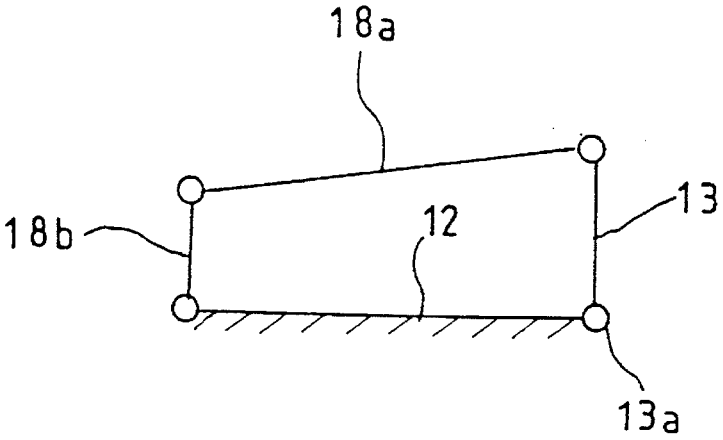
FIG. 5 is a schematic view showing direction of movement of the feeding device of the embodiment FIG. 1.
Figure 6:
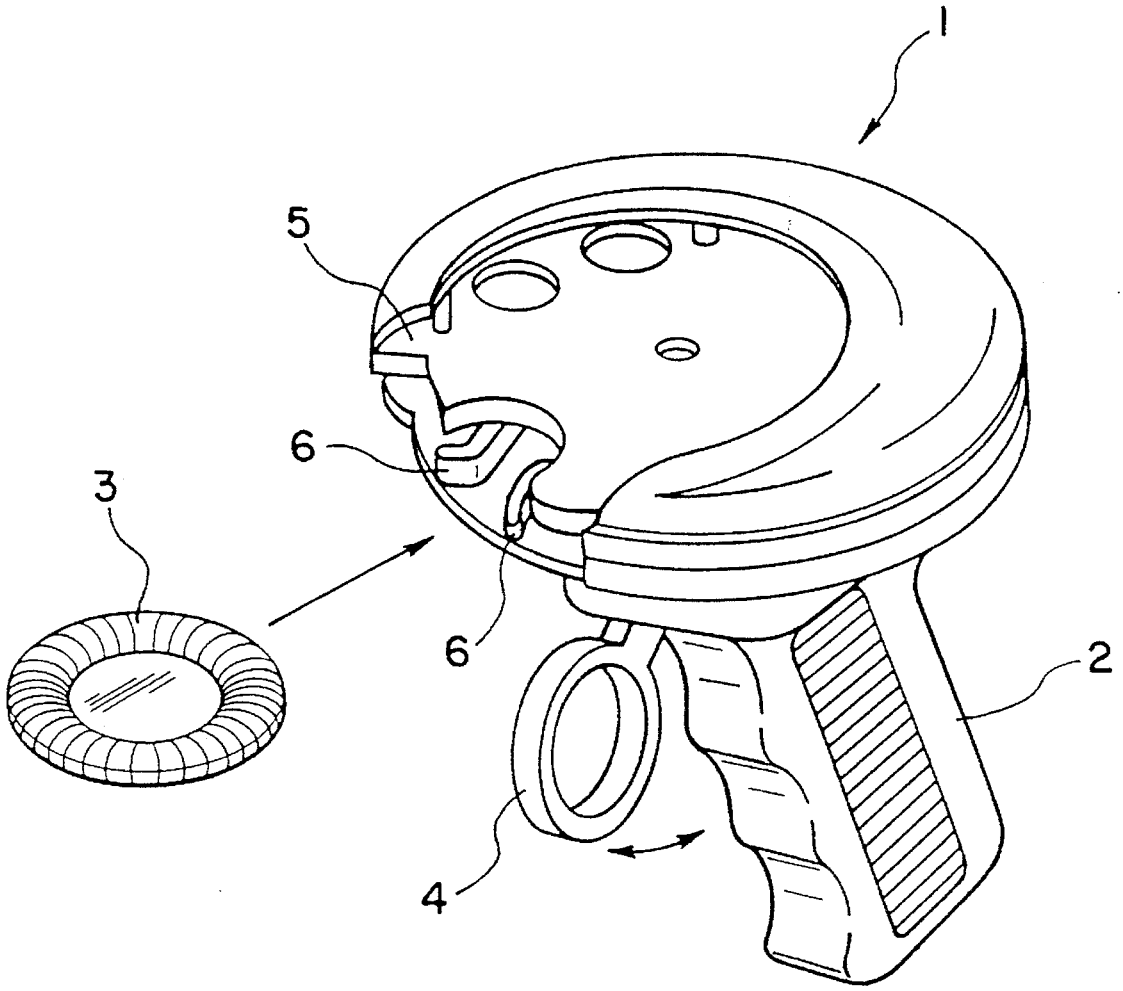
FIG. 6 (PRIOR ART)
FIG. 6 is a perspective view of a known disc discharging device.
Figure 7:
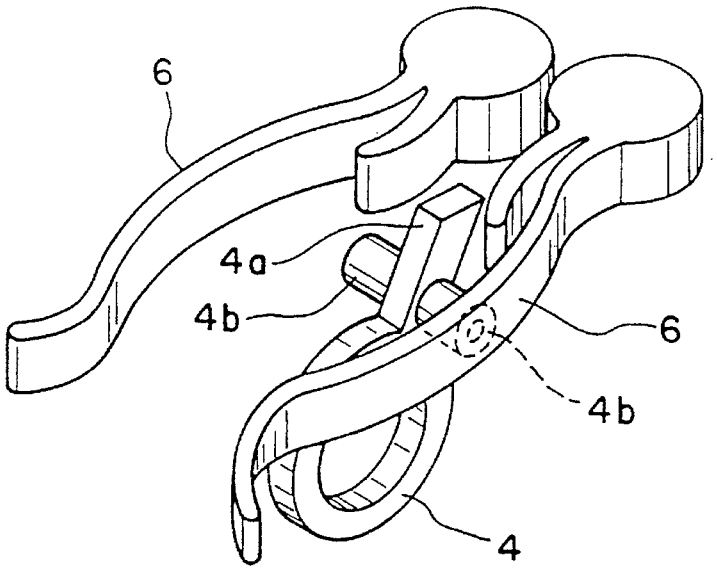
FIG. 7 (PRIOR ART)
FIG. 7 is a perspective view of the spring arms used to provide the discharging force for the device illustrated in FIG. 6.
Figure 8:
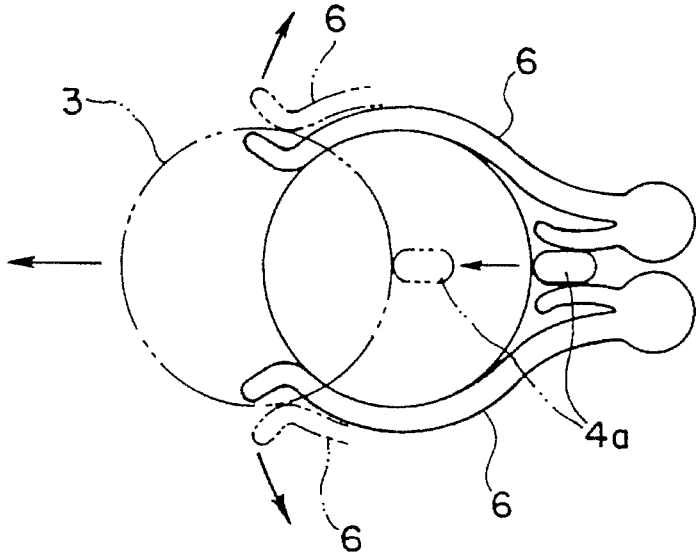
FIG. 8 (PRIOR ART)
FIG. 8 is a top view of the spring arms illustrated in FIG. 7.

As shown in FIG. 4, the trigger 13 comprises a four-joint rotational chain mechanism between links 18*a*, 18*b* and the barrel portion 12. FIG. 5 schematically illustrates this type of mechanism. When the trigger 13 rotates about the shaft 13*a* in the clockwise direction, the link 18*b* is caused to rotate via the link 18*a* in the same direction. The link 18*b* functions to forcibly feed the discs 30 held in the magazine to the discharging position.

Pawls 19*a*, 19*b* provided on the upper surface thereof help facilitate this feeding action. The pawls 19*a*, 19*b* both project into the upper compartment from an opening 16*a* in the partition plate 16 in a state in which the trigger 13 is not pressed. Of the two pawls, the pawl 19*a* confronts a hole in the disc 30 held at the bottom of the discs layered over each other and functions as a stop for the lower-most disc 30. The pawl 19*b* is brought into contact with the rear portion of the bottom-most disc 30, and functions to forcibly feed the disc 30 to the discharging position when the trigger 13 is pressed. In other words, the forcibly feeding device is constituted by the four-joint rotational chain mechanism including the trigger 13.

As shown in FIGS. 1 and 2, the supply portion or magazine 20 comprises an open-ended cylindrical body placed on the partition plate 16 and a lid 20*a* for closing the upper end. The cylindrical body is constructed such as to hold a number of discs 30 in a state in which they are stacked one over the other.

A notch 22*a* substantially equal in width to the diameter of the disc is formed in the bottom front half portion of the magazine 20. The discs 30 held in the magazine 20 are fed to the discharging position through this notch 22*a* by means of the forcibly feeding device. A slit 22*b* is formed in the bottom rear half portion of the cylinder 22 for permitting the movement of the pawl 19*b*.

A discharging mechanism includes the motor M, as seen in FIG. 3, which is provided under the partition plate 16, and a driving roller 41 located on the upper side of the partition plate 16 and being rotatably driven by the motor M. An idler roller 42 is also located on the upper side of the partition plate 16 so as to hold the disc 30 between the driving roller 41 and itself.

In operation, the disc 30 located at a position of the magazine 20 (a position indicated by the letter "A" in FIG. 3) is fed to the discharging position (a position indicated by the letter "B" in FIG. 3) by means of the forcibly feeding device. The disc 30 so fed is designed to be discharged forward by virtue of the rotation of the driving roller 41.

Each disc 30 is resilient and toroidally shaped. By way of example, the discs 30 can be made of rubber, vinyl chloride, a blow-formed article or urethane foam, and polyethylene foam. In a particular embodiment, the discs are made of polyethylene foam. The discs 30 are preferably resilient so as to avoid the risk of injury when a disc strikes a person. Also, the resiliency eases the deformation of the discs when held between the driving roller 41 and the idler roller 42. The toroidal shape is also imparted to the disc for the same reason. Furthermore, it was verified through experiments that a disc of toroidal shape is more stable in flight than a solid disc, and thus achieves an aerodynamic benefit.

With the disc discharging toy 10 configured as described above, since a plurality of discs can be held in the magazine 20 in a state in which they are stacked one over the other, a disc 30 is not required to be loaded every time it is discharged. Instead, the discs can be discharged in a continuous fashion. Moreover, since the loading of discs 30 can be effected merely by putting discs 30 into the supply portion 20, even infants can easily perform such a disc loading operation.

Although the embodiments of the present device have been described as above, the present device is not limited to what have been described, but may be modified in many ways without departing the spirit thereof.

For instance, although in the above embodiment, the disc discharging toy 10 is configured into a pistol-like shape as a whole, any other shape can, of course, be used.

Moreover, in the above embodiment, of the two rollers, one is constituted by a driving roller, and the other by an idler roller, but the two rollers may be constituted by driving rollers. In addition, it is possible to provide two or more idler rollers.

What is claimed is:

1. A hand-held disc discharging toy comprising:

a body having a hand grip;

a plurality of resilient discs;

a magazine mounted on the body and containing the plurality of resilient discs in a stacked disposition;

means for discharging the discs one by one from the body; and means for feeding the discs one by one from the magazine to the discharging means, wherein each said disc includes upper and lower planar surfaces, and a disc axis orthogonal to said upper and lower planar surfaces, wherein the discharging means includes a drive roller driven by a motor, the drive roller engaging each disc and imparting thereto a discharging force when fed into a discharge position by the feeding means, and wherein the drive roller has an axis of rotation parallel to said axis of each resilient disc.

2. A disc discharging toy according to claim 1, wherein each disc is substantially toroidally shaped.

3. A disc discharging toy according to claim 1, wherein each disc is made of a material selected from the group consisting of rubber, vinyl chloride, urethane foam, and polyethylene foam.

4. A disc discharging toy according to claim 1, wherein the body includes a grip portion, and a barrel portion.

5. A disc discharging toy according to claim 1, wherein the discharging means further includes at least one idler roller positioned diametrically opposite the drive roller, thereby defining a gap with the drive roller through which each disc is discharged.

6. A disc discharging toy according to claim 1, wherein the feeding means includes a trigger pivotally mounted in the body, a feed member pivotally mounted in the body at a position spaced from the trigger, and a link connecting the trigger to the feed member.

7. A disc discharging toy according to claim 6, wherein the feed member includes a first pawl which engages each disc on a rearward, outer peripheral edge thereof.

8. A disc discharging toy according to claim 7, wherein the feed member further includes a second pawl which engages each disc at an inner peripheral edge thereof.

9. A disc discharging toy for discharging discs comprising:

a plurality of resilient discs;

a supply portion for holding the plurality of discs in a stacked disposition;

feeding means for forcibly feeding the discs held in said supply portion one by one to a discharging position;

at least two rollers which engage each disc therebetween; and a motor for rotating at least one of the two rollers in a direction in which the discs are to be discharged.

10. A disc discharging toy according to claim 9, wherein the plurality of discs are substantially toroidally shaped.

11. A disc discharging toy according to claim 9, further comprising a grip, wherein the feeding means includes a trigger mounted adjacent the grip, and a feed member operatively coupled to the trigger to forcibly feed each disc to the discharging position.

12. A disc discharging toy comprising:

a plate having two opposite sides, a forward portion and a rearward portion;

means for holding a plurality of discs in a vertical stack over the rearward portion of the plate;

a first roller driven by an electric motor and being positioned on one side of the plate; and means for feeding a lower-most one of the discs into engagement with the first roller, to thereby be discharged from the forward portion of the plate.

13. A disc discharging toy according to claim 12, further comprising a second roller positioned on the opposite side of the plate.

14. A disc discharging toy according to claim 13, wherein the second roller is an idler roller.

15. A disc discharging toy according to claim 12, wherein the feeding means comprises a trigger pivotal about a first axis, a lever pivotal about a second axis, and a linkage connecting the trigger to the lever.

16. A disc discharging toy according to claim 15, wherein the lever includes a first pawl formed on the lever in a position to engage a rearward peripheral edge of the lower-most disc and urge same toward the first roller when the lever is rotated.

17. A disc discharging toy according to claim 12, wherein the holding means comprises a substantially cylindrical magazine having an open bottom.

18. A hand-held disc discharging toy comprising:

a body having a hand grip;

a motor mounted in the body;

a drive roller driven by the motor and having an axis of rotation; and a disc carried by the body and having upper and lower planar surfaces and an axis orthogonal to said upper and lower planar surfaces and substantially parallel to the axis of the drive roller, and a periphery engaged by the drive roller to thereby impart a discharging force to the disc.

* * * * *

US005471967C1

(12) EX PARTE REEXAMINATION CERTIFICATE (8505th)

United States Patent
Matsuzaki et al.

(10) Number: US 5,471,967 C1
(45) Certificate Issued: Sep. 6, 2011

(54) DISC DISCHARGING TOY

(75) Inventors: Tatsuya Matsuzaki, Tokyo (JP); Hisashi Ishida, Tokyo (JP)

(73) Assignee: Toybox Corporation, Taito-ku, Tokyo (JP)

Reexamination Request:
No. 90/011,205, Sep. 2, 2010
No. 90/011,253, Sep. 22, 2010

Reexamination Certificate for:

| | |
|---|---|
| Patent No.: | **5,471,967** |
| Issued: | **Dec. 5, 1995** |
| Appl. No.: | **08/342,022** |
| Filed: | **Nov. 16, 1994** |

(51) Int. Cl.
*F41B 4/00* (2006.01)

(52) U.S. Cl. ..... 124/6; 124/47; 124/51.1; 124/78; 124/82

(58) Field of Classification Search ..... None
See application file for complete search history.

(56) References Cited

U.S. PATENT DOCUMENTS

| | | | | |
|---|---|---|---|---|
| 2,729,206 | A | 1/1956 | Wilson | 124/78 |
| 3,394,694 | A | 7/1968 | Leclerc | |
| 3,515,114 | A | 6/1970 | Carbonneau | |
| 3,641,704 | A | 2/1972 | Sims et al. | |
| RE29,479 | E | 11/1977 | Mohr | |
| 4,248,202 | A | 2/1981 | Jaworski et al. | |
| 4,655,190 | A | 4/1987 | Harris | |
| 4,674,080 | A | 6/1987 | Higuchi et al. | |
| 5,415,151 | A | 5/1995 | Fusi et al. | |
| 5,471,967 | A | 12/1995 | Matsuzaki et al. | 124/6 |

FOREIGN PATENT DOCUMENTS

| | | |
|---|---|---|
| CA | 1221593 | 5/1987 |
| JP | 63121295 | 5/1988 |

*Primary Examiner*—Jeffrey R. Jastrzab

(57) ABSTRACT

A disc discharging toy for discharging discs is provided which comprises a plurality of resilient discs, a magazine for holding the discs in a stacked position, a forcibly feeding device for forcibly feeding the discs so held in the supply portion piece by piece toward a discharging position, and a discharging device for discharging the disc so fed. The discharging device includes two rollers and a motor for rotating at least one of the two rollers in a direction in which the disc is discharged.

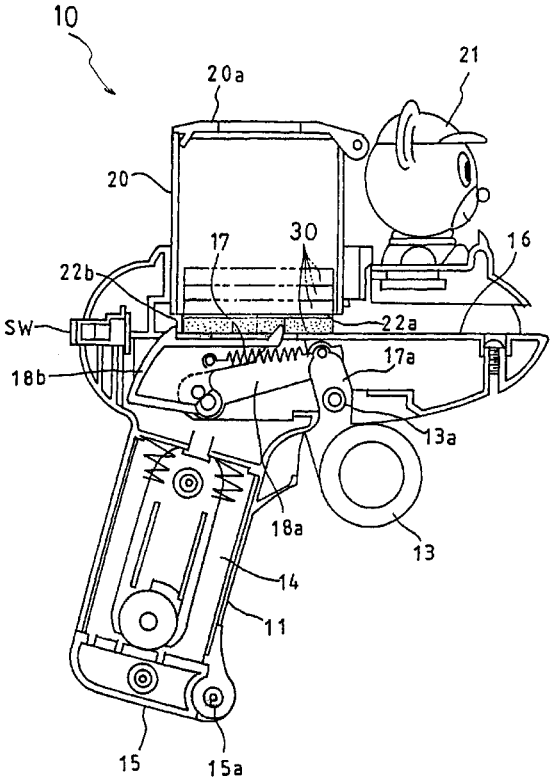

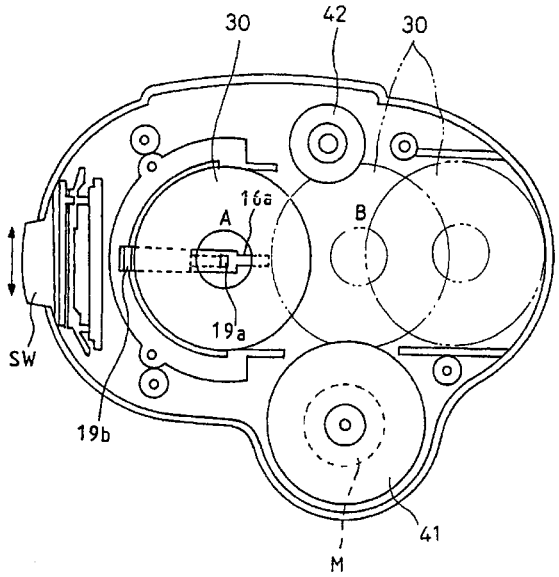

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 9, 12 and 18 are determined to be patentable as amended.

Claims 2-8, 10, 11 and 13-17, dependent on an amended claim, are determined to be patentable.

1. A hand-held disc discharging toy comprising:

a body having a hand grip;

a plurality of resilient discs;

a magazine mounted on the body and containing the plurality of resilient discs in a stacked disposition;

means for discharging the discs one by one from the body; and means for feeding the discs one by one from the magazine to the discharging means, wherein each said disc includes and lower planar surfaces, and a disc axis orthogonal to said upper and lower planar surfaces, wherein the discharging means includes a drive roller driven by a motor, the drive roller engaging each disc and imparting thereto a [discharging] *rotating discharge* force when fed into a discharge position by the feeding means, and wherein the drive roller has an axis of rotation parallel to said axis of each resilient disc.

9. A disc discharging toy for discharging discs comprising:

a plurality of resilient discs;

a supply portion for holding the plurality of discs in a stacked disposition;

feeding means for forcibly feeding the discs held in said supply portion one by one to a discharging position;

at least two rollers which engage each disc therebetween *imparting a rotating discharge force to each disc*; and a motor for rotating at least one of the two rollers in a direction in which the discs are to be discharged.

12. A disc discharging toy comprising:

a plate having two opposite sides, a forward portion and a rearward portion;

means for holding a plurality of *toroidally-shaped* discs in a vertical stack over the rearward portion of the plate;

*a stop surface capable of engaging an inner axial surface of the bottom-most disc in the stack;* a first roller driven by an electric motor and being positioned on one side of the plate; and means for feeding a lower-most one of the discs into engagement with the first roller, to thereby be discharged from the forward portion of the plate.

18. A hand-held disc discharging toy comprising:

a body having a hand grip;

a motor mounted in the body;

a drive roller driven by the motor and having an axis of rotation; and a disc carried by the body and having upper and lower planar surfaces and an axis orthogonal to said upper and lower planar surfaces and substantially parallel to the axis of the drive roller, and a periphery engaged by the drive roller to thereby impart a [discharging] *rotating discharge* force to the disc.

* * * * *